US008257892B2

(12) United States Patent
Wu et al.

(10) Patent No.: US 8,257,892 B2
(45) Date of Patent: Sep. 4, 2012

(54) RELEASABLE UNDERCOAT LAYER AND METHODS FOR USING THE SAME

(75) Inventors: Jin Wu, Pittsford, NY (US); Yuhua Tong, Webster, NY (US); Helen R. Cherniack, Rochester, NY (US); Edward F. Grabowski, Webster, NY (US); Kent J. Evans, Lima, NY (US); Nancy L. Belknap, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 269 days.

(21) Appl. No.: 12/692,521

(22) Filed: Jan. 22, 2010

(65) Prior Publication Data

US 2011/0183244 A1 Jul. 28, 2011

(51) Int. Cl.
*G03G 5/14* (2006.01)

(52) U.S. Cl. ..... 430/65; 430/60; 430/64; 399/159

(58) Field of Classification Search ..... 430/60, 430/64, 65; 399/159
See application file for complete search history.

(56) References Cited

U.S. PATENT DOCUMENTS

| | | | |
|---|---|---|---|
| 3,121,006 | A | 2/1964 | Middleton et al. |
| 4,286,033 | A | 8/1981 | Neyart et al. |
| 4,291,110 | A | 9/1981 | Lee |
| 4,338,387 | A | 7/1982 | Hewitt |
| 4,464,450 | A | 8/1984 | Teuscher |
| 4,518,669 | A | 5/1985 | Yashiki |
| 4,579,801 | A | 4/1986 | Yashiki |
| 4,587,189 | A | 5/1986 | Hor et al. |
| 4,664,995 | A | 5/1987 | Horgan et al. |
| 4,775,605 | A | 10/1988 | Seki et al. |
| 4,921,773 | A | 5/1990 | Melnyk et al. |
| 5,017,449 | A | 5/1991 | Yoshihara |
| 5,153,094 | A | 10/1992 | Kazmaier et al. |
| 5,166,339 | A | 11/1992 | Duff et al. |
| 5,189,155 | A | 2/1993 | Mayo et al. |
| 5,189,156 | A | 2/1993 | Mayo et al. |
| 5,344,734 | A | 9/1994 | Monbaliu et al. |
| 5,489,496 | A | 2/1996 | Katayama et al. |
| 5,641,599 | A | 6/1997 | Markovics et al. |
| 5,656,407 | A | 8/1997 | Kawahara |
| 5,721,080 | A | 2/1998 | Terrell et al. |
| 5,756,245 | A | 5/1998 | Esteghamatian et al. |
| 6,180,309 | B1 | 1/2001 | Maty et al. |
| 6,200,716 | B1 | 3/2001 | Fuller et al. |
| 6,207,334 | B1 | 3/2001 | Dinh et al. |
| 2003/0162123 | A1 * | 8/2003 | Barr et al. ..... 430/270.1 |
| 2006/0057480 | A1 * | 3/2006 | Lin et al. ..... 430/65 |
| 2006/0210908 | A1 * | 9/2006 | Umemura et al. ..... 430/125 |

* cited by examiner

*Primary Examiner* — Peter Vajda
(74) *Attorney, Agent, or Firm* — Pillsbury Winthrop Shaw Pittman LLP

(57) ABSTRACT

Embodiments relate generally to an imaging member that facilitates removal of the imaging member coating layers disposed over the imaging member and environmentally or "green" methods for using the same. More specifically, the present embodiments disclose an electrophotographic photoreceptor that includes a specifically formulated undercoat layer that allows easy removal of the photoreceptor layers disposed on top of the undercoat layer. The present embodiments provide a simple yet efficient method for reclaiming recycling or remanufacturing electrophotographic photoreceptors.

18 Claims, 1 Drawing Sheet

RELEASABLE UNDERCOAT LAYER AND METHODS FOR USING THE SAME

CROSS REFERENCE TO RELATED APPLICATIONS

Reference is made to co-pending, commonly assigned U.S. patent application Ser. No. 12/692,437, filed on Jan. 22, 2010, entitled, "Releasable Undercoat Layer and Methods for Using the Same".

BACKGROUND

This disclosure relates generally to photoreceptor that facilitates removal of the photoreceptor coatings disposed over an electrophotographic photoreceptor and environmentally or "green" methods for using the same. More specifically, the present embodiments disclose a photoreceptor that includes a specifically formulated undercoat layer that allows easy removal of the photoreceptor layers disposed on top of the undercoat layer. The present embodiments provide a simple yet efficient method for reclaiming recycling or remanufacturing electrophotographic photoreceptors.

In electrophotography, the substrate for photoreceptors in a rigid drum format is required to be manufactured with high dimensional accuracy in terms of straightness and roundness, optimum surface reflectance and roughness, and desired thickness. In order to obtain such a dimensional accuracy, the substrate surface is polished at a high accuracy by using sand blustering, glass bead honing, or a diamond tool and/or the like. Once the substrate surface is formed, at least one coating of photosensitive material is applied to the substrate, which may comprise a charge generation layer and a charge transport layer, or their blended in a single layer, to form a full photoreceptor device.

Current photoreceptor may be commonly comprised of an aluminum substrate having specific dimensions required for straightness, roundness and counter bore concentricity. For example, the wall needs to be minimized for efficient raw material cost but also thick enough to meet the one time machining requirements and physical requirements of the finished photoreceptor device. A defect-free surface with maximum reflectivity is provided by diamond machining to a mirror finish followed by glass bead honing. A maximum surface roughness is also specified. Preparation of the aluminum substrate surface is important in maintaining uniform, defect-free print quality. Minimizing the reflectivity of the surface, eliminates a defect causes by surface reflections that has the appearance of a plywood patterns in half tone areas of prints. Exceeding the maximum surface roughness leads to charge injection and high background.

The final product generally comprises three organic coatings, an undercoat layer (UCL), that functions as a primer, a charge generation and a charge transport, and in some cases, an anti-reflective coating and hole blocking layer. The final assembly has two end caps (or flanges). One end cap comprises a drive gear and the other end cap comprises of a bearing and ground strap that has a spring contact to the bearing shaft and a friction contact to the inner substrate surface. The end caps are held in place with an epoxy adhesive and must meet a specified torque and push out force after a specified thermal cycle test condition.

The fabricated photoreceptor devices are expected to have good electrical and mechanical performance in a copier or printer. But, due to complexity of the manufacturing process, it is unavoidable to have varieties of defects in some photoreceptor devices which may not meet the quality requirements for the copier or printer. The defective devices have to be rejected. In another aspect, each photoreceptive device has limited application life. Once the photoreceptor device cannot function well in the machine, it is also the end of the application life of the device. These used photoreceptor devices were usually disposed in the same way as the defective devices were treated. Disposal of the device could be very costly and could cause lots of environmental issues.

Remanufacturing such a photoreceptor device is difficult because the device dimensions are very specific and minor changes can adversely impact the results. For example, there is a specific balance between the substrate surface reflectance and surface roughness that must be maintained. Moreover, such photoreceptors have wall thicknesses that are too thin to re-machine, the coating layers comprise polymers that are chemically resistant to all but the most aggressive, and often non-environmentally friendly, solvents. For example, organic photoreceptors with the current undercoat layers are very difficult to reclaim using the current acid/alcohol stripping solution at elevated temperatures.

Moreover, methods to effectively and completely remove coated photoreceptor layers from substrates for re-use are plagued by the necessity to use harsh chemicals including acids or solvents that frequently require large quantities that increase the costs for hazardous waste disposal and may pose safety concerns. A release layer to facilitate the removal of coated layers in an environmentally friendly solvent will reduce the cost of the substrate reclaiming process and result in significant cost savings by enabling substrate re-use.

Thus, there exists a need for safe and environmentally-friendly methods to recycle or reclaim electrophotographic photoreceptor devices that would address the above-identified problems. Furthermore, there is a need to reduce the cost of remanufacturing electrophotographic photoreceptors, for example, by recycling the non-usable photoreceptor devices, through removing the photosensitive or coating layers without damaging the substrate formation. This would not only reduce the cost of producing the photoreceptor, but also decreases the cost for disposing all related materials in the devices.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

The terms used to describe the imaging members, their layers and respective compositions, may each be used interchangeably with alternative phrases known to those of skill in the art. For example, the term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule." The terms used herein are intended to cover all such alternative phrases.

SUMMARY

According to aspects illustrated herein, there is provided an imaging member comprising a substrate, an undercoat layer disposed on the substrate, a charge generation layer disposed on the undercoat layer, and a charge transport layer disposed on the charge generation layer, the undercoat layer comprising a metal oxide and a polyalkylene glycol benzoate dispersed in a polymer.

In another embodiment, there is provided a n imaging member comprising a substrate, an undercoat layer disposed on the substrate, a charge generation layer disposed on the undercoat layer, and a charge transport layer disposed on the charge generation layer, the undercoat layer comprising a metal oxide and a polypropylene glycol benzoate dispersed in a polymer, wherein the polypropylene glycol benzoate comprises the following structure

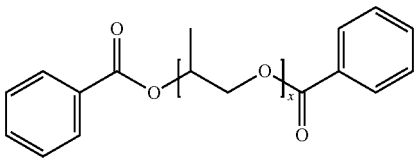

and further wherein x=1, 2, 3, 4, 5 or 6.

In yet another embodiment, there is provided an image forming apparatus for forming images on a recording medium comprising a) an imaging member having a charge retentive-surface for receiving an electrostatic latent image thereon, wherein the imaging member comprises a substrate, a undercoat layer disposed on the substrate, a charge generation layer disposed on the undercoat layer, and a charge transport layer disposed on the charge generation layer, the undercoat layer comprising a metal oxide and a polyalkylene glycol benzoate dispersed in a polymer, b) a development component for applying a developer material to the charge-retentive surface to develop the electrostatic latent image to form a developed image on the charge-retentive surface, c) a transfer component for transferring the developed image from the charge-retentive surface to a copy substrate, d) a fusing component for fusing the developed image to the copy substrate, and e) a cleaning component for removing any developer material remaining on the charge-retentive surface, wherein the cleaning component removes the removable protective layer after a first few cycles of operation of the image forming apparatus and directs the removed developer material to a toner waste container.

BRIEF DESCRIPTION OF THE DRAWINGS

For a better understanding, reference may be had to the accompanying FIGURE.

The FIGURE illustrates an electrophotographic photoreceptor showing various layers in accordance with the present embodiments.

DETAILED DESCRIPTION

Figure 1:
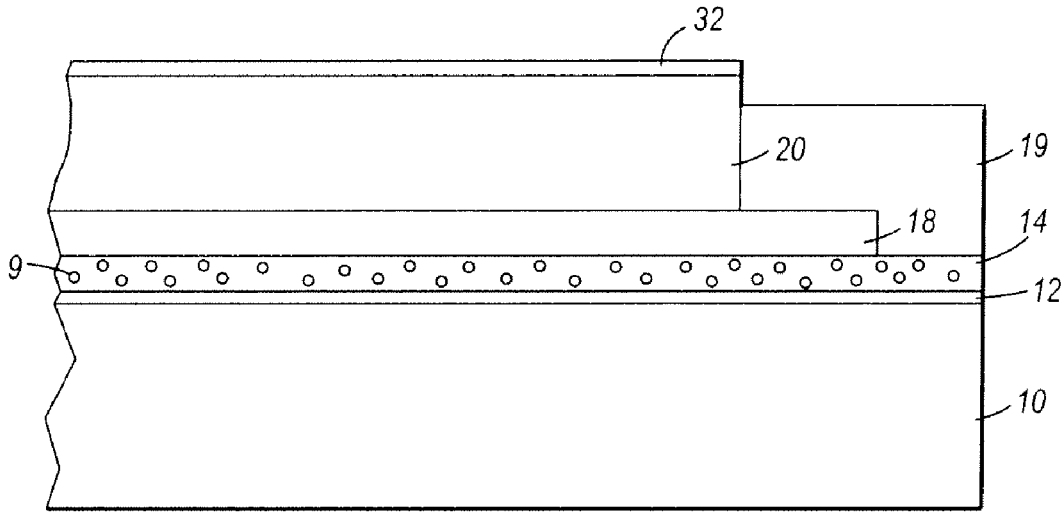

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

This disclosure relates generally to a photoreceptor that allows easy release or removal of photoreceptor coatings from the substrate and environmentally-friendly methods for using the same. More specifically, the present embodiments discloses a photoreceptor coatings removal method which is based on an electrophotographic photoreceptor comprising a specifically formulated undercoat layer that facilitates easy release or removal of the photoreceptor layers from the substrate by immersing in an environmentally-friendly stripping solution.

Currently used organic photoreceptors use an undercoat layer formulation known as "TUC6" which is generally a phenolic resin coating with a metal oxide, such as $TiO_2$, dispersed in it. Photoreceptor layers including the undercoat layer, such as for example, the charge generation layer and the charge transport layer, are very hard to remove and the conventional approach for reclaiming or recycling organic photoreceptor drums is lathing, which is labor-intensive and time-consuming. Other methods used to effectively and completely remove coated photoreceptor layers from substrates for re-use are plagued by the necessity to use harsh chemicals including acids or solvents that frequently require large quantities that increase the costs for hazardous waste disposal and may pose safety concerns. For example, TUC6 drums are very difficult to reclaim using the current acid/alcohol stripping solution at elevated temperatures.

The present embodiments provide a modified undercoat layer which further includes polypropylene glycol (PPG) benzoate into the TUC6 coating formulation. The undercoat layer and other layers disposed on the undercoat layer, were easily released from the rest of the photoreceptor when immersed in an environmentally-friendly stripping solution. Moreover, the photoreceptor of the present embodiments exhibited good adhesion and electrical properties comparable to a control device. Using an existing photoreceptor layer that can facilitate the removal of all the coated layers in an environmentally friendly stripping solution will reduce the cost of the substrate reclaiming process and result in significant cost savings by enabling substrate re-use. Thus, the present embodiments provide an environmentally-friendly and simple yet efficient method for reclaiming, recycling or remanufacturing electrophotographic photoreceptors.

The FIGURE illustrates a photoreceptor of the present embodiments showing various layers and having a drum configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the FIGURE, the charge generation layer may also be disposed on top of the charge transport layer. Other layers of the imaging member may include, for example, an optional over coat layer 32. Overcoat layers are commonly included to increase mechanical wear and scratch resistance to prolong the life of photoreceptor device. In the present embodiments, the undercoat layer 14 is modified to include a polypropylene glycol ester 9. It will be appreciated that the functional components of these layers may alternatively be combined into a single layer.

The Substrate

An electrically conducting substrate may be any metal, for example, aluminum, nickel, steel, copper, and the like or a polymeric material, filled with an electrically conducting substance, such as carbon, metallic powder, and the like, or an organic electrically conducting material. In certain embodiments, the substrate is made from aluminum or an aluminum alloy.

The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or, of a minimum thickness of less than a millimeter. Similarly, a flexible belt may be of substantial thickness, for example, about 250 microns, or of minimum thickness less than 50 microns, provided there are no adverse effects on the final electrophotographic device. The wall thickness of the drum substrate is manufactured to be at least about 0.25 mm to fulfill the physical requirements of the photoreceptor device. In one embodiment, the thickness of the substrate is from about 0.25 mm to about 5 mm. In one embodiment, the thickness of the substrate is from about 0.5 mm to about 3 mm. In one embodiment, the thickness of the substrate is from about 0.9 mm to about 1.1 mm. However, the thickness of the substrate can also be outside of these ranges.

The surface of the substrate is polished to a mirror-like finish by a suitable process such as diamond turning, metallurgical polishing, glass bead honing and the like, or a combination of diamond turning followed by metallurgical polishing or glass bead honing. Minimizing the reflectivity of the surface may eliminate defects caused by surface reflections that have the appearance of a plywood patterns in half tone areas of prints. Exceeding certain surface roughness, for example, 5 microns, may lead to undesirable and non-uniform electrical properties across the device, which cause poor imaging quality. In certain embodiments, the surface roughness of the substrate is controlled to be less than 1 microns, or less than 0.5 microns.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micron to about 10 microns or from about 1 micron to about 10 microns, or in a specific embodiment, about 3 microns. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micron, or no more than 10 microns, and in further embodiments have a thickness of at least about 2 microns, or no more than 6 microns.

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Undercoat Layer

After deposition of the electrically conductive ground plane layer, the undercoat layer or hole blocking layer 14 may be applied thereto. Electron blocking layers for positively charged photoreceptors allow holes from the imaging surface of the photoreceptor to migrate toward the conductive layer. F or negatively charged photoreceptors, any suitable hole blocking layer capable of forming a barrier to prevent hole injection from the conductive layer to the opposite photoconductive layer may be utilized.

In the present embodiments, the undercoat layer comprises a metal oxide, a polymer, and a polyalkylene glycol benzoate. The undercoat layer of the present embodiments can be readily removed with a mild solution stripping process, and thus, the photoreceptor coating layers can be readily removed without the need of the pre-lathing step. In specific embodiments, the metal oxide used is $TiO_2$. When compared with the conventional undercoat layer comprising only $TiO_2$ dispersed in a polymer, the photoreceptors of the present embodiments exhibit comparable or better performance, such as for example, photoinduced discharge curve (PIDC), cyclic stability, background and lower ghosting.

The metal oxide may generally be any conductive metal which can be oxidized. In particular embodiments, the metal may be titanium (Ti), tin (Sn), zinc (Zn), indium (In), silicon (Si), aluminum (Al), zirconium (Zr), or molybdenum (Mb). In specific embodiments, the metal oxide is titanium dioxide ($TiO_2$) or zinc oxide (ZnO).

In embodiments, the metal oxide (like $TiO_2$) used in the undercoat layer can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Commercially available examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

The metal oxide may be present in suitable amounts, such as for example, from about 5 weight percent to about 80 weight percent, and more specifically, from about 30 weight percent to about 70 weight percent, of the undercoat layer. In embodiments, the metal oxide has a diameter of from about 5 nanometers to about 300 nanometers. More specifically, the metal oxide may possess a primary particle size diameter of from about 10 nanometers to about 25 nanometers, and yet more specifically, about 15 nanometers with an aspect ratio (i.e. ratio of longest axis to shortest axis) of from about 4 to about 5. The metal oxide may optionally be surface treated with a component containing from about 1 percent by weight to about 3 percent by weight of alkali metal, such as a sodium metaphosphate.

The polymer may be a binder resin such as a thermosetting or thermoplastic resin. The polymer is, in embodiments, a phenolic resin, a melamine resin, an epoxy resin, a polyamide resin, a polyvinyl butyral resin, a polyurethane resin, a poly (vinyl carbazole), an organosilane, nylon, polyesters, polyvinylidene chloride resin, silicone resins, fluorocarbon resins, polycarbonates, polyacrylates and methacrylates, copolymers of vinyl chloride and vinyl acetate, phenoxy resins, poly(vinyl alcohol), polyacrylonitrile, polystyrene, poly(vinylbenzyl alcohol), poly(2-hydroxyethyl methacrylate), poly (2-hydroxyethyl acrylate), poly(3-hydroxypropyl methacrylate), or mixtures thereof. In specific embodiments, the polymer is a phenolic resin. The polymer may comprise from about 20 weight percent to about 95 weight percent of the undercoat layer, including from about 30 weight percent to about 70 weight percent.

A phenolic resin is generally formed as the condensation product of an aldehyde with a phenol source in the presence of an acidic or basic catalyst.

The phenol source can be, for example, phenol; alkyl-substituted phenols such as cresols and xylenols; halogen-substituted phenols such as chlorophenol; polyhydric phenols such as resorcinol or pyrocatechol; polycyclic phenols such as naphthol and bisphenol A; aryl-substituted phenols, cycloalkyl-substituted phenols, aryloxy-substituted phenols, and combinations thereof. Exemplary phenol sources include 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and combinations thereof.

The aldehyde used to make the phenolic resin can be, for example, formaldehyde, paraformaldehyde, acetaldehyde, butyraldehyde, paraldehyde, glyoxal, furfuraldehyde, propinonaldehyde, benzaldehyde, and combinations thereof. In various embodiments, the aldehyde can be formaldehyde.

Phenolic resins include dicyclopentadiene type phenolic resins, phenol novolak resins, cresol novolak resins, phenol aralkyl resins, and combinations thereof. Exemplary phenolic resins include formaldehyde polymers with phenol, p-tert-butylphenol, and cresol, such as VARCUM™ 29159 and 29101 (OxyChem. Co.) and DURITE™ 97 (Borden Chemical); formaldehyde polymers with ammonia, cresol, and phenol, such as VARCUM™ 29112 (OxyChem. Co.); formaldehyde polymers with 4,4'-(1-methylethylidene) bisphenol such as VARCUM™ 29108 and 29116 (OxyChem. Co.); formaldehyde polymers with cresol and phenol such as VARCUM™ 29457 (OxyChem. Co.), DURITE™ SD-423A, SD-422A (Borden Chemical); or formaldehyde polymers with phenol and p-tert-butylphenol such as DURITE™ ESD 556C (Border Chemical).

The polyalkylene glycol benzoate is represented by or encompassed by

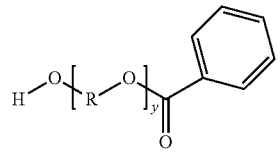

or

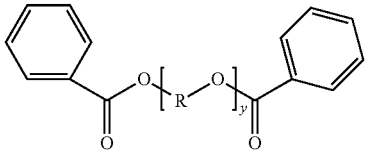

wherein R is alkylene as illustrated herein, and, for example, from 1 carbon atom to about 12 carbon atoms, from 2 carbon atoms to about 10 carbon atoms, from 2 carbon atoms to about 6 carbon atoms, and more specifically 1, 2, 3, 4, 5, or 6 carbon atoms, such as methyl, ethyl, propyl, butyl, pentyl, hexyl, and the like and the mixtures thereof; y represents the number of repeating units of the alkylene glycol, and where y is, for example, from about 1 to about 50, from about 1 to about 20, or from about 1 to about 6.

The polyalkylene glycol benzoate possesses, for example, a number average molecular weight ($M_n$) of from about 150 to about 10,000, or from about 200 to about 1,000, and a weight average molecular weight ($M_w$) of from about 200 to about 20,000, or from about 300 to about 2,000 where $M_w$ and $M_n$ were determined by Gel Permeation Chromatography (GPC).

Examples of polyalkylene glycol benzoates are polypropylene glycol dibenzoates represented by

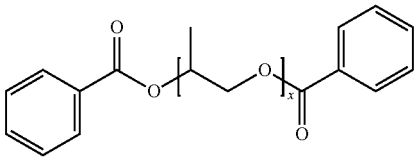

available as UNIPLEX® 400 (x=3); UNIPLEX® 988 (x=2); and UNIPLEX® 284 (x=1), all available from Unitex Chemical Corporation.

In particular embodiments, the polyalkylene glycol benzoate comprises from about 0.1 weight percent to about 30 weight percent of the undercoat layer. In more specific embodiments, the polyalkylene glycol benzoate comprises from about 1 weight percent to about 20 weight percent or from about 2 weight percent to about 10 weight percent of the undercoat layer.

The undercoat layer thickness can be of any suitable value, such as for example, from about 0.1 micron to about 30 microns, from about 1 micron to about 20 microns, or from about 3 microns to about 15 microns.

The undercoat layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the undercoat layer is preferably applied in the form of a dilute solution, with the solvent being removed after deposition of the coating by conventional techniques such as by vacuum, heating and the like. The undercoat layer may be dried at a temperature of from about 40° C. to about 200° C. for a suitable period of time, such as from about 1 minute to about 10 hours, under stationary conditions or in an air flow.

Generally, polyalkylene glycol benzoates are soluble in solvents such as xylene, 1-butanol, methyl ethyl ketone, tetrahydrofuran, 1-methoxy-2-propanol, and the like and mixtures thereof. For example, they are soluble in a solvent mixture of 50% xylene and 50% 1-butanol. Appropriate solvent mixtures can be used to form a dispersion of the metal oxide, phenolic resin, and polyalkylene glycol benzoate. The order in which these three ingredients is added to the dispersion is not important. The dispersion is then applied and the solvent evaporated to form the undercoat layer. The undercoat layer may be useful, for example, as a charge blocking layer.

Methods for removing layers of an imaging member from a substrate are contemplated. In particular, substrate reclamation is easier for an imaging member comprising a substrate and an undercoat layer that comprises a metal oxide, a polymer, and a polyalkylene glycol benzoate.

In one embodiment, a method for reclaiming an imaging member that first comprises immersing the imaging member in a liquid bath. The imaging member comprises a substrate, undercoat layer disposed on the substrate, and one or more coating layers disposed on the undercoat layer, the undercoat layer comprising a metal oxide and a polyalkylene glycol benzoate dispersed in a polymer. In embodiments, the imaging member is immersed in the liquid bath for from about 2 minutes to about 60 minutes. In further embodiments, the temperature of the liquid bath is heated from about 40° C. to about 95° C. After immersion, the undercoat layer is released from the substrate such that the one or more coating layers are separated from the substrate. In embodiments, the releasing step includes peeling or scraping off the undercoat layer and the one or more coating layers.

In embodiments, the liquid bath is selected from the group consisting of water, isopropanol, N-methylpyrrolidone, ethanol, dimethylsulfoxide, N,N'-dimethylformamide, N,N'-dimethylacetamide, citric acid, acetic acid, nitric acid, oxalic acid, phosphoric acid, hydrochloric acid, sulfuric acid and mixtures thereof.

In further embodiments, the method of reclaiming uses a stripping solution as the liquid bath. The stripping solution comprises a solvent, an acid, and water. In such embodiments, the immersion separates the undercoat layer, and the other layers on top of the undercoat layer, from the substrate. In some embodiments, the imaging member needs to be immersed for as little as 5 minutes or even 3 minutes to remove all residues from the substrate.

The solvent used in the stripping solution may comprise N-methylpyrrolidone, ethanol, dimethylsulfoxide, N,N'-dimethylformamide, N,N'-dimethylacetamide, similar solvents, and mixtures thereof. The stripping solution may comprise an acid selected from the group consisting of citric acid, acetic acid, nitric acid, oxalic acid, phosphoric acid, hydrochloric acid, sulfuric acid, similar acids, and mixtures thereof. In some embodiments, the acid is citric acid. In a specific embodiment, the solution comprises 80 weight percent of N-methylpyrrolidone, 8 weight percent of citric acid, and 12 weight percent of water.

In other embodiments, the stripping solution may be ARMAKLEEN (available from The ArmaKleen Company, Princeton, N.J.) or NATRASOLVE (available from Johnson-Diversey Inc., Sturtevant, Wis.). The liquid bath may be slightly agitated to encourage dissolution of the releasable undercoat layer. To further facilitate the removal process, the solvent may be heated from about 50° C. to about 95° C. for about 2 minutes to about 30 minutes.

Generally, the hole blocking layer may also include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3\ Si(OCH_3)_2$, (gamma-aminobutyl) methyl diethoxysilane, and $[H_2N(CH_2)_3]CH_3\ Si(OCH_3)_2$ (gamma-aminopropyl)methyl diethoxysilane, as disclosed in U.S. Pat. Nos. 4,338,387, 4,286,033 and 4,291,110.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of less than 1 μm, or about 0.25 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 15 microns to about 50 microns, and more specifically, of a thickness of from about 15 microns to about 40 microns. Examples of charge transport components are aryl amines of the following formulas/structures:

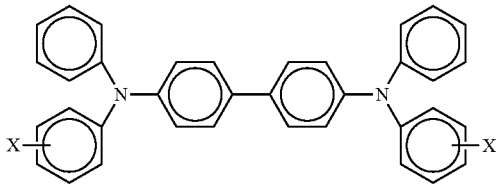

and

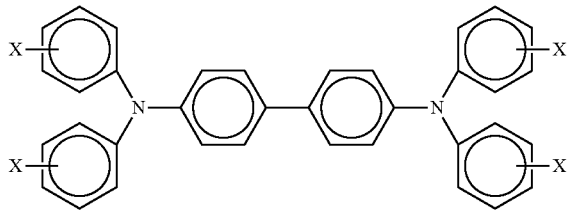

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

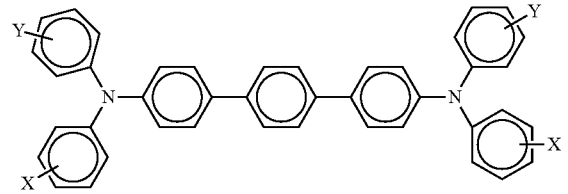

and

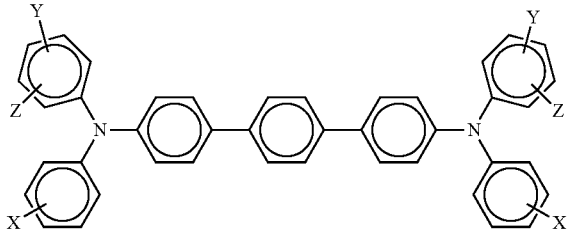

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER® BHT-R, MDP-S, BBM-S, WX-R, NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in the FIGURE, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 microns, or no more than about 900 microns after drying. In embodiments, the dried thickness is from about 0.03 microns to about 1 micron.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 microns generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 microns, or no more than about 42 microns, or of at least about 14 microns, or no more than about 27 microns.

The Anti-Curl Back Coating Layer

In belt configurations, there may include an anti-curl back coating. The anti-curl back coating layer may comprise organic polymers or inorganic polymers that are electrically insulating or slightly semi-conductive. The anti-curl back coating provides flatness and/or abrasion resistance.

The anti-curl back coating may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 microns, or no more than about 35 microns, or about 14 microns.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The present embodiments will be described in further detail with reference to the following examples and comparative examples. All the "parts" and "%" used herein mean parts by weight and % by weight unless otherwise specified.

Several exemplary stripping solution conditions of the present embodiments were studied in the following examples.

Comparative Example 1

An undercoat layer dispersion was prepared by milling 18 grams of $TiO_2$ (MT-150W, manufactured by Tayca Co., Japan) and 12 grams of a phenolic resin dissolved in 12 grams of a solvent mixture of xylene and 1-butanol (VARCUM® 29159, OxyChem. Co., phenolic resin was about 50 percent in a 50/50 mixture of xylene/1-butanol), and a total solid content of about 48 percent in an attritor mill with about 0.4 millimeter to about 0.6 millimeter size $ZrO_2$ beads for 6.5 hours, and then filtering with a 20 micron Nylon filter. A 30 millimeter aluminum drum substrate was then coated with the aforementioned generated dispersion using known coating techniques as illustrated herein. After drying at 160° C. for 20 minutes, an undercoat layer of $TiO_2$ in the phenolic resin ($TiO_2$/phenolic resin=60/40 w/w) about 8 microns in thickness was obtained.

A charge generation layer comprising chlorogallium phthalocyanine (Type C) was deposited on the above undercoat layer at a thickness of about 0.2 micron. The charge generating layer coating dispersion was prepared as follows. 2.7 grams of chlorogallium phthalocyanine (ClGaPc) Type C pigment were mixed with 2.3 grams of the polymeric binder (carboxyl modified vinyl copolymer, VMCH, Dow Chemical Company), 15 grams of n-butyl acetate, and 30 grams of xylene. The resulting mixture was milled in an attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 30 micron charge transport layer was coated on top of the charge generating layer from a dispersion prepared from N,N'-diphenyl-N,N-bis(3-methylphenyl)-1,1'-biphenyl-4,4'-diamine (5.38 grams), a film forming polymer binder, PCZ-400 [poly(4,4'-dihydroxy-diphenyl-1-1-cyclohexane, $M_w$=40,000)] available from Mitsubishi Gas Chemical Company, Ltd. (7.13 grams), and PTFE POLYFLON™ L-2 microparticle (1 gram), available from Daikin Industries, dissolved/dispersed in a solvent mixture of 20 grams of tetrahydrofuran (THF), and 6.7 grams of toluene through a CAVIPRO™ 300 nanomizer (Five Star Technology, Cleveland, Ohio). The charge transport layer was dried at about 120° C. for about 40 minutes.

Example 1

A photoconductor was prepared by repeating the above process of Comparative Example 1, except that 0.6 gram of polypropylene glycol (PPG) dibenzoate (available as UNIPLEX® 400 and obtained from Unitex Chemical Corporation; weight average molecular weight of about 400 as determined by GPC analysis) was added into the undercoat layer dispersion of Comparative Example 1. A 30 millimeter aluminum drum substrate was then coated with the aforementioned generated dispersion using known coating techniques as illustrated herein. After drying at 160° C. for 20 minutes, an undercoat layer of $TiO_2$ in the phenolic resin and the citrate ($TiO_2$/phenolic resin/PPG dibenzoate=58.8/39.2/2 w/w/w) about 8 microns in thickness was obtained.

Example 2

A photoconductor was prepared by repeating the above process of Comparative Example 1, except that 1.5 grams of polypropylene glycol (PPG) dibenzoate (available as UNIPLEX® 400 and obtained from Unitex Chemical Corporation; weight average molecular weight of about 400 as determined by GPC analysis) was added into the undercoat layer dispersion of Comparative Example 1. A 30 millimeter aluminum drum substrate was then coated with the aforementioned generated dispersion using known coating techniques as illustrated herein. After drying at 160° C. for 20 minutes, an undercoat layer of $TiO_2$ in the phenolic resin and the citrate ($TiO_2$/phenolic resin/PPG dibenzoate=57.1/38.1/4.8 w/w/w) about 8 microns in thickness was obtained.

Example 3

A photoconductor was prepared by repeating the above process of Comparative Example 1, except that 3.0 grams of polypropylene glycol (PPG) dibenzoate (available as UNIPLEX® 400 and obtained from Unitex Chemical Corporation; weight average molecular weight of about 400 as determined by GPC analysis) was added into the undercoat layer dispersion of Comparative Example 1. A 30 millimeter aluminum drum substrate was then coated with the aforementioned generated dispersion using known coating techniques as illustrated herein. After drying at 160° C. for 20 minutes, an undercoat layer of $TiO_2$ in the phenolic resin and the citrate ($TiO_2$/phenolic resin/PPG dibenzoate=54.5/36.4/9.1 w/w/w) about 8 microns in thickness was obtained.

Electrical Testing

The above prepared photoconductors of Comparative Example 1, and Examples 1, 2 and 3 were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. These four photoconductors were tested at surface potentials of 700 volts with the exposure light intensity incrementally increased by regulating a series of neutral density filters; the exposure light source was a 780 nanometer light emitting diode. The xerographic simulation was completed in an environmentally controlled light tight chamber at dry conditions (10 percent relative humidity and 22° C.).

The above prepared photoconductors exhibited substantially similar PIDCs. Thus, incorporation of the citrate in the undercoat layer did not adversely affect the electrical properties of the photoconductor.

Ghosting Measurement

The Comparative Example 1 and Example 3 photoconductors were acclimated in A zone conditions (85° F. and 80 percent humidity) for 24 hours before being print tested for A zone ghosting. Print testing was accomplished in the Xerox Corporation WorkCentre™ Pro C3545 using the K (black toner) station at t=500 print counts. At the CMY stations of the color WorkCentre™ Pro C3545, run-up from t=500 print counts for the photoconductor was completed. The print for determining ghosting characteristics includes an X symbol or letter on a half tone image. When the X is invisible, the ghost level is assigned Grade 0; when X is barely visible, the ghost level is assigned Grade 1; Grade 2 to Grade 5 refers to the level of visibility of X with Grade 5 meaning a dark and visible X. Ghosting levels were visually measured against an empirical scale: the smaller the ghosting grade (absolute value), the better the print quality. A negative ghosting grade refers to a negative ghosting. The ghosting results are summarized in Table 1.

TABLE 1

| UCL composition | A zone ghosting T = 500 | J zone ghosting T = 500 |
|---|---|---|
| Comparative Example 1 (no PPG dibenzoate) | −4 | −5+ |
| Example 3 (9.1 weight percent of PPG dibenzoate) | −3 | −4.5 |

The Comparative Example 1 and Example 3 photoconductors were also acclimated in J zone conditions (70° F. and 10 percent humidity) for 24 hours before similarly print tested for J zone ghosting. The ghosting results are also summarized in Table 1. Incorporation of the PPG dibenzoate into the undercoat layer reduced the ghosting by about 1 grade in both A zone and J zone, which was a better print quality characteristic.

Adhesion Testing

The adhesion for Comparative Example 1 and Examples 1, 2, and 3 between the coating layers and the substrate was tested using the following protocol. In this adhesion test, the drum was scored with a razor in a crosshatch pattern with 4-6 mm spacing. A 1" piece of tape was affixed to the device and then removed to determine the amount of delamination onto the tape. The results are included in Table 2. The scale ranges from Grade 1 to Grade 5 where Grade 1 results in almost no delamination and Grade 5 results in almost complete delamination.

TABLE 2

| UCL composition | Adhesion Grade |
|---|---|
| Comparative Example 1 (no PPG dibenzoate) | 1.5 |
| Example 1 (2 weight percent of PPG dibenzoate) | 1.5 |
| Example 2 (4.8 weight percent of PPG dibenzoate) | 1.5 |
| Example 3 (9.1 weight percent of PPG dibenzoate) | 2.0 |

Incorporation of the PPG dibenzoate into the undercoat layer gradually weakened the adhesion between the coating layers and the substrate. For example, adding about 9.1% of the PPG dibenzoate (Example 3) into the undercoat layer weakened the adhesion by about half a grade. The adhesion for Examples 1 and 2 was also weakened although the difference in the weakening effect is not shown from this specific testing method. However, the difference can be shown from the following coating layer removal test.

Coating Layer Removal

The photoconductors of Comparative Example 1 and Examples 1, 2, and 3 were immersed in a solution of 80 weight percent of N-methyl-2-pyrrolidone (NMP), 8 weight percent of citric acid, and 12 weight percent of water at 85° C. The coating layer removal was compared with immersion time, and the immersion time was recorded in Table 3 when all the coating layers were removed from the substrate.

TABLE 3

| | Immersion time for coating layer removal |
|---|---|
| Comparative Example 1 (no PPG dibenzoate) | After 5 minutes, still lots of coating layers left |
| Example 1 (2 weight percent of PPG dibenzoate) | 4 minutes |
| Example 2 (4.8 weight percent of PPG dibenzoate) | 3 minutes |
| Example 3 (9.1 weight percent of PPG dibenzoate) | 3 minutes |

Incorporation of the PPG dibenzoate into the undercoat layer facilitated the coating layer removal. It took about 3 to 4 minutes to completely remove the coating layers from the substrate for Examples 1, 2 and 3 (photoconductors with PPG dibenzoate in the undercoat layer). In contrast, after 5 minutes immersion, there were still lots of coating layers left on the substrate for the Comparative Example 1 photoconductor (no PPG dibenzoate in the undercoat layer).

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

What is claimed is:

1. An imaging member comprising:

a substrate;

a undercoat layer disposed on the substrate;

a charge generation layer disposed on the undercoat layer; and a charge transport layer disposed on the charge generation layer; wherein the undercoat layer comprises a metal oxide and a polypropylene glycol benzoate dispersed in a polymer;

wherein the polypropylene glycol benzoate comprising the following structure

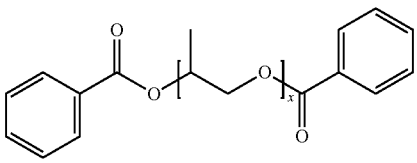

wherein x=1, 2, 3, 4, 5 or 6;

wherein the polymer is selected from the group consisting of a phenolic resin, a melamine resin, an epoxy resin, a polyamide resin, a polyvinyl butyral resin, a polyurethane resin, a poly(vinyl carbazole), an organosilane, nylon, polyesters, polyvinylidene chloride resin, silicone resins, fluorocarbon resins, polycarbonates, copolymers of vinyl chloride and vinyl acetate, phenoxy resins, poly(vinyl alcohol), polyacrylonitrile, polystyrene, poly(vinylbenzyl alcohol), and mixtures thereof.

2. The imaging member of claim 1, wherein the metal oxide is present in an amount of from about 20 percent by weight to about 80 percent by weight of the total weight of the undercoat layer.

3. The imaging member of claim 2, wherein the metal oxide is present in an amount of from about 40 percent by weight to about 70 percent by weight of the total weight of the undercoat layer.

4. The imaging member of claim 1, wherein the polypropylene glycol benzoate is present in an amount of from about 0.1 percent by weight to about 30 percent by weight of the total weight of the undercoat layer.

5. The imaging member of claim 4, wherein the polypropylene glycol benzoate is present in an amount of from about 1 percent by weight to about 20 percent by weight of the total weight of the undercoat layer.

6. The imaging member of claim 1, wherein the polymer is a phenolic resin present in an amount of from about 30 percent by weight to about 60 percent by weight of the total weight of the undercoat layer.

7. The imaging member of claim 1, wherein the polymer is present in an amount of from about 20 percent by weight to about 70 percent by weight of the total weight of the undercoat layer.

8. The imaging member of claim 1, wherein the polypropylene glycol benzoate is selected from the group consisting of polypropylene glycol dibenzoate, propylene glycol dibenzoate, dipropylene glycol dibenzoate, and mixtures thereof.

9. The imaging member of claim 1, wherein the undercoat layer has a thickness of from about 0.1 micron to about 30 microns.

10. The imaging member of claim 9, wherein the undercoat layer has a thickness of from about 1 micron to about 15 microns.

11. The imaging member of claim 1, wherein the metal oxide is selected from the group consisting of $TiO_2$, ZnO, and mixtures thereof.

12. An imaging member comprising:

a substrate;

a undercoat layer disposed on the substrate;

a charge generation layer disposed on the undercoat layer; and a charge transport layer disposed on the charge generation layer, the undercoat layer comprising a metal oxide and a polypropylene glycol benzoate dispersed in a polymer, wherein the polypropylene glycol benzoate;

is selected from the group consisting of polypropylene glycol dibenzoate, propylene glycol dibenzoate, dipropylene glycol dibenzoate, and mixtures thereof;

wherein the polymer is selected from the group consisting of a phenolic resin, a melamine resin, an epoxy resin, a polyamide resin, a polyvinyl butyral resin, a polyurethane resin, a poly(vinyl carbazole), an organosilane, nylon, polyesters, polyvinylidene chloride resin, silicone resins, fluorocarbon resins, polycarbonates, copolymers of vinyl chloride and vinyl acetate, phenoxy resins, poly(vinyl alcohol), polyacrylonitrile, polystyrene, poly(vinylbenzyl alcohol), and mixtures thereof.

13. The imaging member of claim 12, wherein the polypropylene glycol benzoate is polypropylene glycol dibenzoate.

14. The imaging member of claim 12, wherein the metal oxide is present in an amount of from about 20 percent by weight to about 80 percent by weight of the total weight of the undercoat layer, the polypropylene glycol benzoate is present in an amount of from about 0.1 percent by weight to about 30 percent by weight of the total weight of the undercoat layer, and the polymer is present in an amount of from about 20 percent by weight to about 70 percent by weight of the total weight of the undercoat layer.

15. The imaging member of claim 12, wherein the undercoat layer has a thickness of from about 0.1 micron to about 30 microns.

16. An image forming apparatus for forming images on a recording medium comprising:

a) an imaging member having a charge retentive-surface for receiving an electrostatic latent image thereon, wherein the imaging member comprises a substrate;

a undercoat layer disposed on the substrate;

a charge generation layer disposed on the undercoat layer; and a charge transport layer disposed on the charge generation layer, the undercoat layer comprising a metal oxide and a polypropylene glycol benzoate dispersed in a polymer;

b) a development component for applying a developer material to the charge-retentive surface to develop the electrostatic latent image to form a developed image on the charge-retentive surface;

c) a transfer component for transferring the developed image from the charge-retentive surface to a copy substrate;

d) a fusing component for fusing the developed image to the copy substrate; and a cleaning component for removing any developer material remaining on the charge-retentive surface, wherein the cleaning component removes the removable protective layer after a first few cycles of operation of the image forming apparatus and directs the removed developer material to a toner waste container;

wherein the polypropylene glycol benzoate comprising the following structure

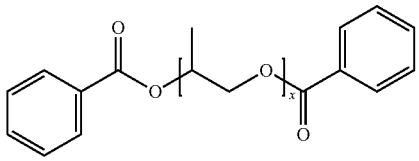

wherein x=1, 2, 3, 4, 5 or 6;

wherein the polymer is selected from the group consisting of a phenolic resin, a melamine resin, an epoxy resin, a polyamide resin, a polyvinyl butyral resin, a polyurethane resin, a poly(vinyl carbazole), an organosilane, nylon, polyesters, polyvinylidene chloride resin, silicone resins, fluorocarbon resins, polycarbonates, copolymers of vinyl chloride and vinyl acetate, phenoxy resins, poly(vinyl alcohol), polyacrylonitrile, polystyrene, poly(vinylbenzyl alcohol), and mixtures thereof.

17. The imaging member of claim 12, wherein the polymer is a phenolic resin.

18. The imaging member of claim 17, wherein the phenolic resin is derived from an aldehyde and a phenol source.

* * * * *